US009815299B2

(12) United States Patent
Kao

(10) Patent No.: US 9,815,299 B2
(45) Date of Patent: Nov. 14, 2017

(54) IMAGING APPARATUS

(71) Applicant: AVISION INC., Hsinchu (TW)

(72) Inventor: Jan-Hsing Kao, Miaoli County (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 15/331,656

(22) Filed: Oct. 21, 2016

(65) Prior Publication Data

US 2017/0120623 A1 May 4, 2017

(30) Foreign Application Priority Data

Nov. 4, 2015 (TW) ..... 104136347 A

(51) Int. Cl.
*B41J 2/47* (2006.01)
*G03G 21/18* (2006.01)
*G03G 21/16* (2006.01)

(52) U.S. Cl.
CPC ..... *B41J 2/47* (2013.01); *G03G 21/1666* (2013.01); *G03G 21/1842* (2013.01); *G03G 21/1619* (2013.01)

(58) Field of Classification Search
CPC ..... B41J 2/47; B41J 2/435; B41J 2/447; B41J 2/45; B41J 2/475
See application file for complete search history.

(56) References Cited

U.S. PATENT DOCUMENTS 5,089,846 A * 2/1992 Tabuchi ..... G03G 15/326 347/149
5,291,249 A * 3/1994 Lee ..... B41J 29/02 347/130
7,649,543 B2 * 1/2010 Tanabe ..... B41J 2/45 347/242

* cited by examiner

*Primary Examiner* — Huan Tran

(57) ABSTRACT

An imaging apparatus includes frame, rotatable member, exposing and imaging assembly. The frame includes accommodation space, lower and upper surfaces on the accommodation space. The rotatable member includes pressed portion, pivoting portion and arm. The pivoting portion pivots to the frame. The scanning assembly assembled to the arm and has image capturing position and lifted position. The scanning assembly at the image capturing position is away from the upper surface. The scanning assembly at the lifted position is close to the upper surface. The imaging assembly includes toner cartridge and photosensitization unit. The toner cartridge has pressing surface facing the upper surface. The imaging assembly is rotatable relative to the frame to move the toner cartridge to be alternatively close to or away from the upper surface. When the toner cartridge is close to the upper surface, the pressing surface presses the pressed portion to lift the scanning assembly.

13 Claims, 6 Drawing Sheets

IMAGING APPARATUS

CROSS-REFERENCE TO RELATED APPLICATIONS

This non-provisional application claims priority under 35 U.S.C. §119(a) on Patent Application No(s). 104136347 filed in Taiwan, R.O.C. on Nov. 4, 2015, the entire contents of which are hereby incorporated by reference.

TECHNICAL FIELD

The disclosure relates to an imaging apparatus, more particularly to an imaging apparatus having a movable scanning assembly.

BACKGROUND

In terms of the technology utilized, printers fall into two categories: LED printers and laser printers. The LED printer uses a light-emitting diode array as a light source in the print head. The printer head with the LED array is usually cheaper than the printer head with the laser due to its simplicity and a longer lifespan. In addition, the mechanical reliability, the compact design and the fewer moving parts of the LED printer makes the LED printers more popular than the laser printers.

However, in the LED printer, the lens assembly used in the print head has very short focal length. The distance from light emitters to the focus point on the photoconductive drum is only about 0.5 mm to about 1 mm. Developers usually design a protection mechanism in the LED printer for preventing the damage of the photoconductive drum on the toner cartridge caused by the collision between the print head and the photoconductive drum during replacing the toner cartridge. The protection mechanism is, for example, a multi-bar linkage or a security lock mechanism.

SUMMARY

The present disclosure provides an imaging apparatus configured for decreasing the complexity of assembling the imaging assembly without damaging the photoconductive drum and the print head.

One embodiment of the disclosure provides an imaging apparatus including a frame, at least one rotatable member, a scanning assembly and an imaging assembly. The frame includes an accommodation space, a lower surface and a upper surface. The lower surface and the upper surface are located on two sides of the accommodation space which are opposite to each other, respectively. The at least one rotatable member includes a pressed portion, a pivoting portion and an arm. The pivoting portion is pivoted to the frame and adjacent to the upper surface. The pivoting portion is located between and connected to the pressed portion and the arm. The scanning assembly is assembled to the arm and has an image capturing position and a lifted position relative to the upper surface. The scanning assembly is movable between the image capturing position and the lifted position by the arm. The scanning assembly is away from the upper surface when the scanning assembly is at the image capturing position. The scanning assembly is close to the upper surface when the scanning assembly is at the lifted position. The imaging assembly is rotatable and detachably disposed in the accommodation space. The imaging assembly is located between the scanning assembly and the lower surface. The imaging assembly includes a toner cartridge and a photosensitization unit which are connected to each other. The toner cartridge has at least one pressing surface. The at least one pressing surface faces the upper surface and corresponds to the pressed portion. The imaging assembly is rotatable relative to the frame to move the toner cartridge to be alternatively close to or away from the upper surface. When the toner cartridge is away from the upper surface, the scanning assembly is at the image capturing position and adjacent to the photosensitization unit. When the toner cartridge is close to the upper surface, the at least one pressing surface of the toner cartridge presses the pressed portion of the rotatable member. The scanning assembly is rotated to the lifted position by the at least one rotatable member, and the scanning assembly at the lifted position is away from the photosensitization unit.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

Figure 1:
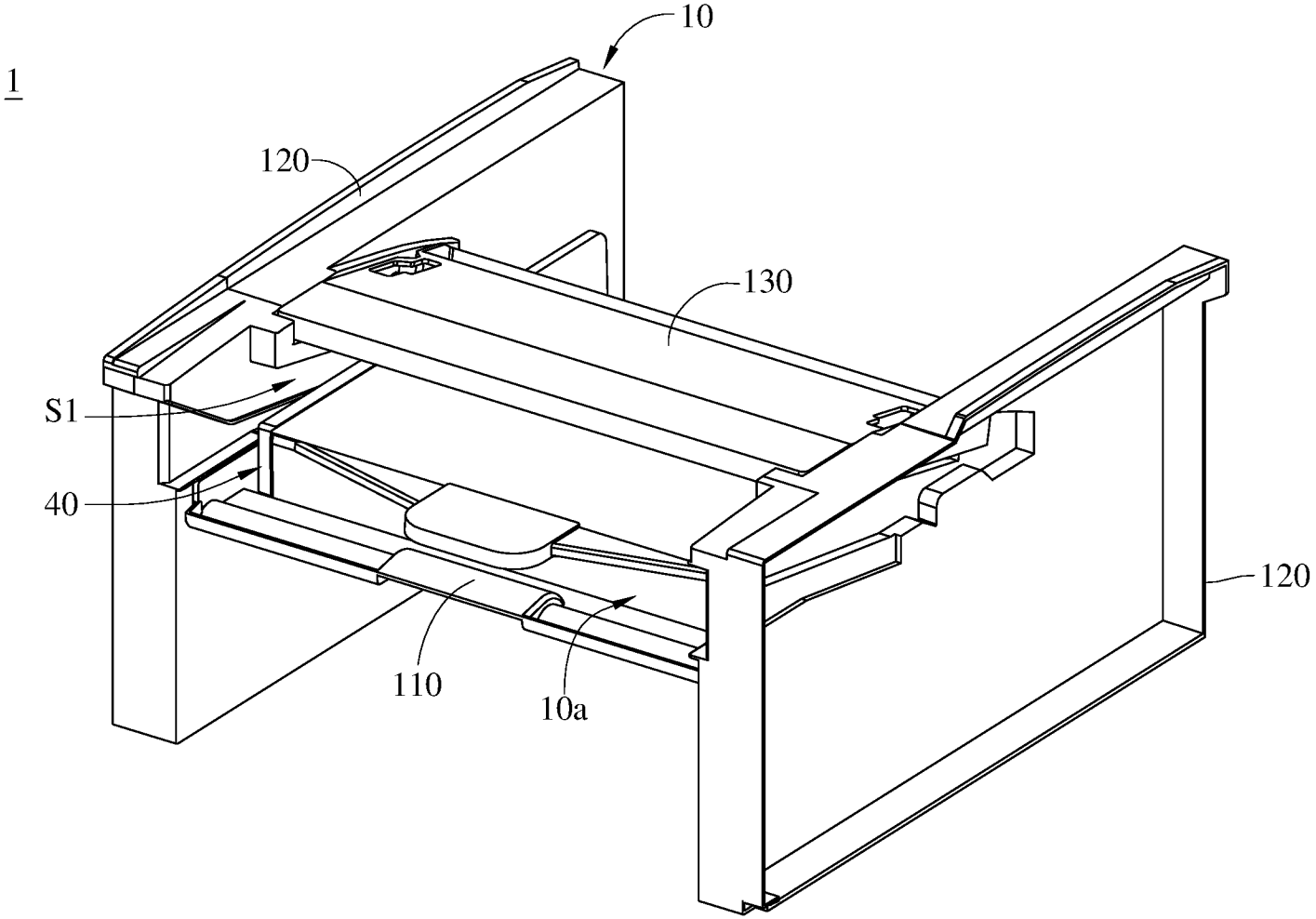
FIG. 1 is a perspective view of an imaging apparatus according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
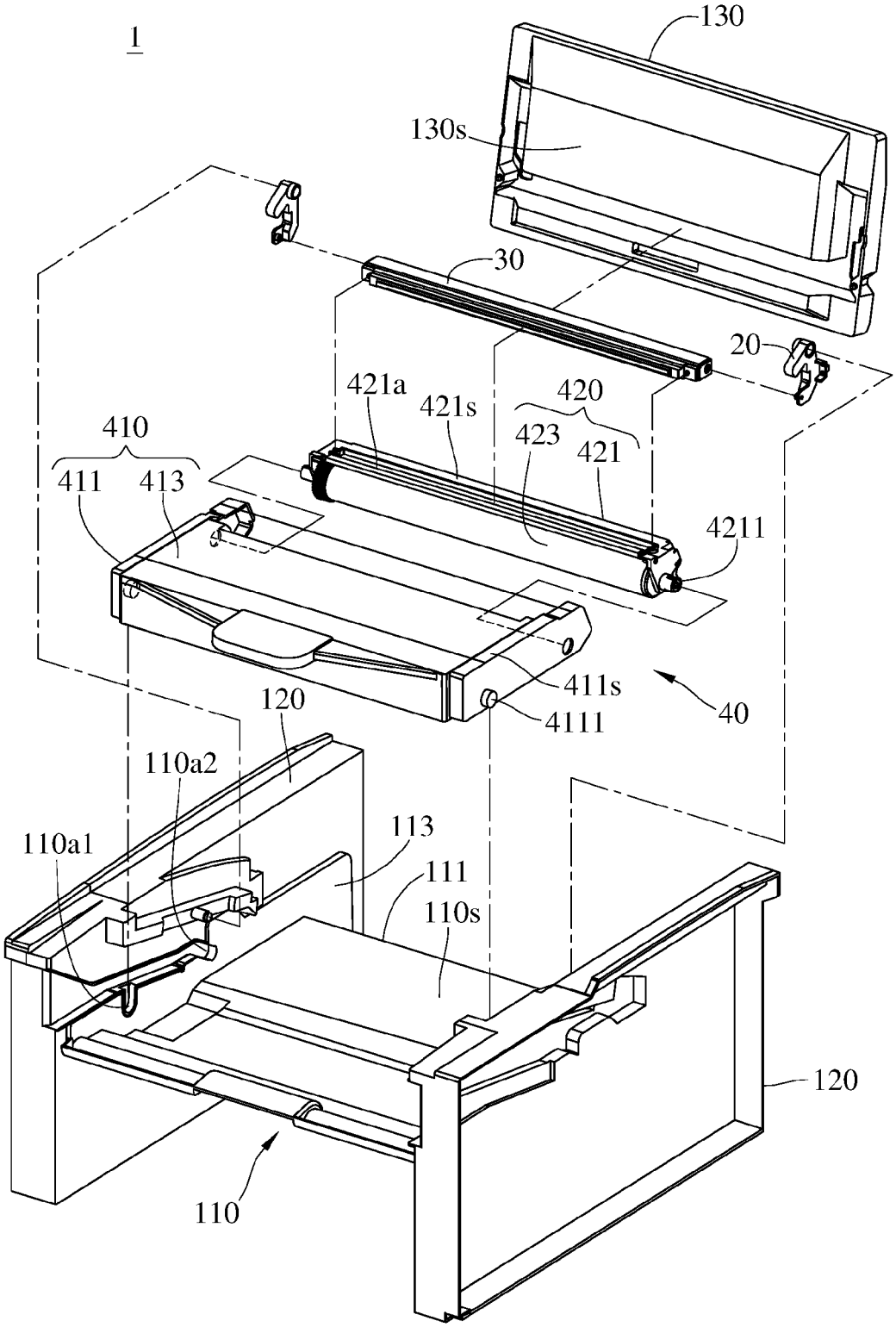
FIG. 2 is an exploded view of the imaging apparatus according to the embodiment of the disclosure.
Figure 3:
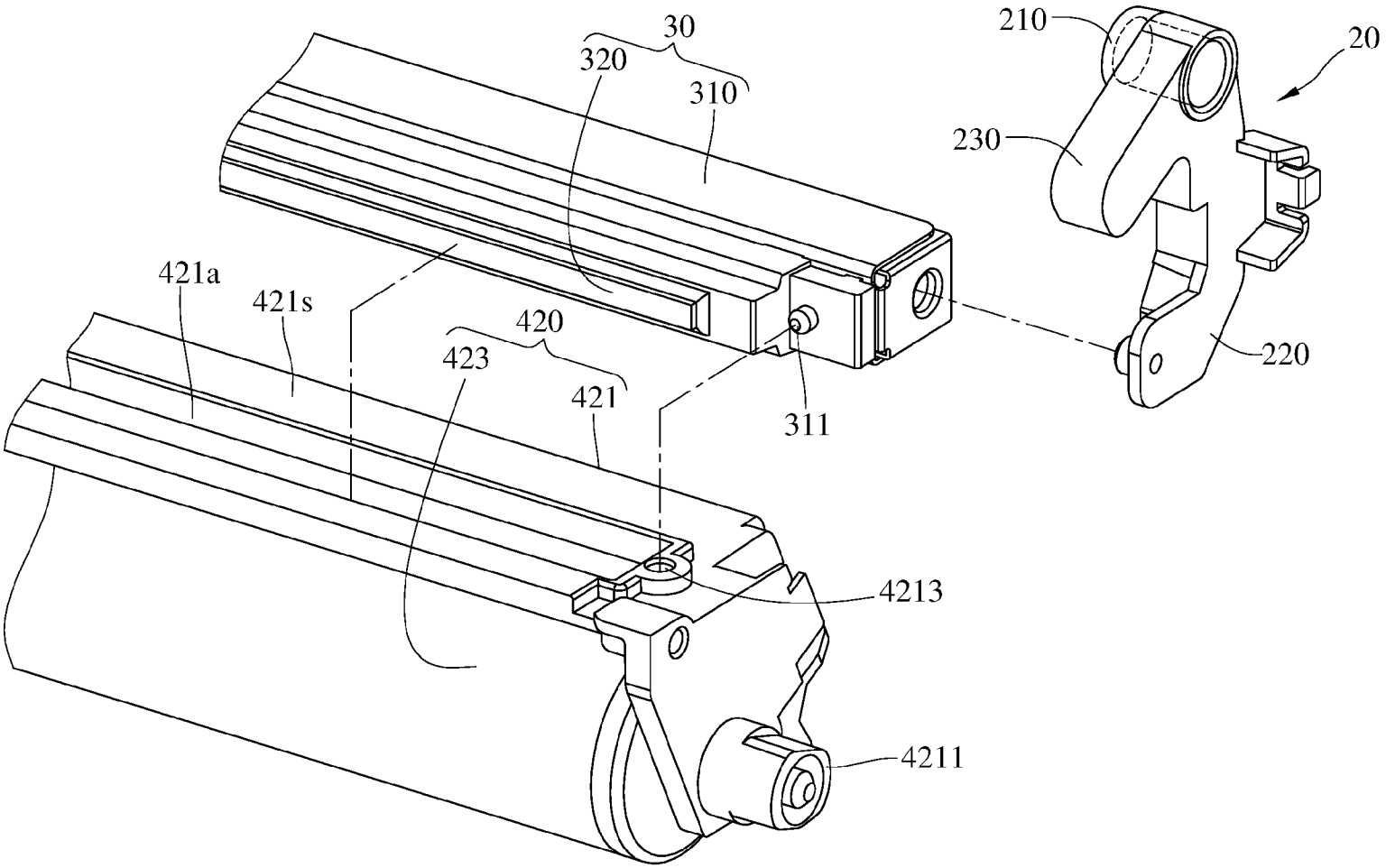
FIG. 3 is an enlarged view of a scanning assembly, a photosensitization unit and one of rotatable members as shown in FIG. 2.
Figure 4:
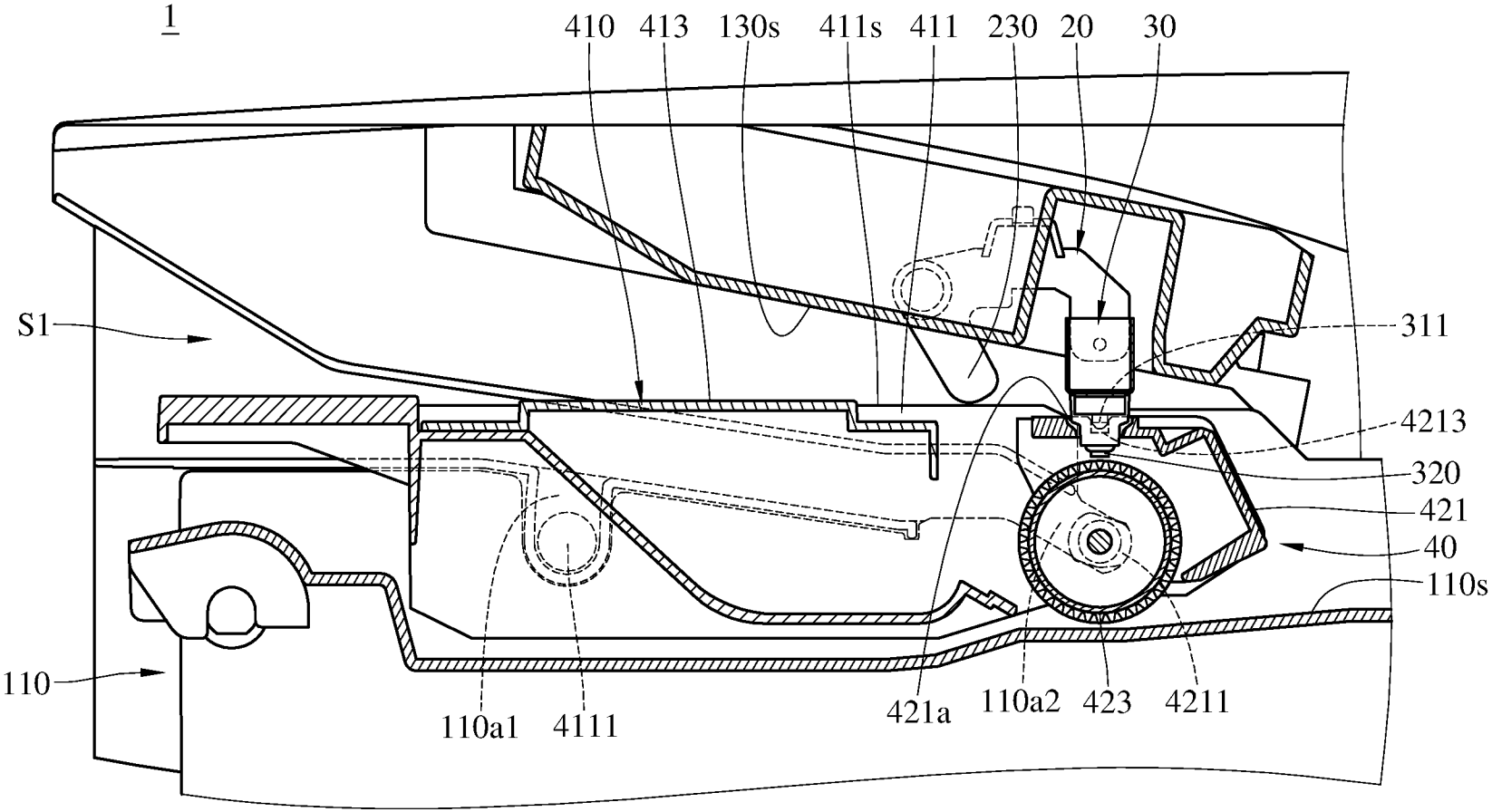
FIG. 4 is a side view of the imaging apparatus according to the embodiment of the disclosure.

Please refer to FIG. 1 to FIG. 4. FIG. 1 is a perspective view of an imaging apparatus according to an embodiment of the disclosure. FIG. 2 is an exploded view of the imaging apparatus according to the embodiment of the disclosure. FIG. 3 is an enlarged view of a scanning assembly, a photosensitization unit and one of rotatable members as shown in FIG. 2. FIG. 4 is a side view of the imaging apparatus according to the embodiment of the disclosure.

This embodiment provides an imaging apparatus 1 for printers. The imaging apparatus 1 includes a frame 10, two rotatable members 20, a scanning assembly 30 and an imaging assembly 40.

The frame 10 includes a bearing plate 110, two side plate assemblies 120 and a top plate 130. The two side plate assemblies 120 are disposed on two sides of the bearing plate 110 which are opposite to each other, respectively. The top plate 130 is disposed between the two side plate assemblies 120 and opposite to the bearing plate 110. The bearing plate 110, the two side plate assemblies 120 and the top plate 130 define and surround an accommodation space S1 configured for accommodating the imaging assembly 40.

Please refer to FIG. 1 to FIG. 3. For purposes of clear explanation, one of the side plate assemblies 120 is omitted in FIG. 3. In this embodiment, the frame 10 has a lower surface 110*s* and an upper surface 130*s*. The lower surface 110*s* is on the bearing plate 110. The upper surface 130*s* is on the top plate 130. The lower surface 110*s* faces the top plate 130, and the upper surface 130*s* faces the bearing plate 110. The lower surface 110*s* and the upper surface 130*s* are disposed on two sides of the accommodation space S1 which are opposite to each other, respectively. The bearing plate 110 includes a bottom part 111 and two side parts 113. The two side parts 113 are connected to two sides of the bottom plate 111 which are opposite to each other, respectively. The lower surface 110*s* is on the bottom part 111. Each of the two side parts 113 has a first groove 110*a*1 and a second groove 110*a*2 which are facing the upper surface 130*s* and configured for positioning the imaging assembly 40. As shown in FIG. 2, the first groove 110*a*1 and the second groove 110*a*2 are located above the lower surface 110*s*.

In addition, the frame 10 further has an accommodation opening 10*a* connected to a side of the accommodation space S1. The accommodation opening 10*a* is located between the upper surface 130*s* and the lower surface 110*s* for installing the imaging assembly 40 into the accommodation space S1.

Each of the two rotatable members 20 includes a pivoting portion 210, an arm 220 and a pressed portion 230. The pivoting portion 210 is located between and connected to the pressed portion 230 and the arm 220. The pivoting portion 210 is pivoted to the side plate assembly 120 of the frame 10 and adjacent to the upper surface 130*s*. Thus, the rotatable members 20 are located relatively away from the lower surface 110*s*.

In this embodiment, the pressed portion 230, the pivoting portion 210 and the arm 220 are connected to one another to from a U-shaped member. The pressed portion 230 and the arm 220 protrude from the upper surface 130*s*. The arm 220 and the pressed portion 230 are able to be moved in the accommodation space S1 by the rotation of the pivoting portion 210.

Please see both FIG. 2 and FIG. 3, the scanning assembly 30 includes a print head carrier 310 and a print head 320. The print head carrier 310 is assembled between the two arms 220 of the rotatable member 20. In details, two ends of the print head carrier 310 which are opposite to each other are connected to the two arms 220 of the rotatable member 20, respectively. The print head 320 is disposed on the print head carrier 310 for exposing the imaging assembly 40. In this embodiment, the print head 320 is a light emitting diode print-head (LPH).

Accordingly, the rotatable member 20 is able to drive the scanning assembly 30 to move in the accommodation space S1, and thus the scanning assembly 30 has an image capturing position and a lifted position. In detail, the image capturing position is away from the upper surface 130*s*, and the lifted position is close to the upper surface 130*s*. The rotatable member 20 is able to alternatively move the scanning assembly 30 to the image capturing position and the lifted position. When the scanning assembly 30 is at the image capturing position, the scanning assembly 30 is located relatively away from the upper surface 130*s*. When the scanning assembly 30 is at the lifted position, the scanning assembly 30 is located relatively close to the upper surface 130*s*.

In this embodiment, each of the two rotatable members 20 is equipped with an elastic member (not shown) such as a tension springs or a torsion spring configured for returning the rotatable member 20 to its initial position, but the present disclosure is not limited thereto. In other embodiments, the rotatable member 20 can return to its initial position by its own weight.

In addition, as shown in FIG. 3, in this embodiment, the print head carrier 310 has two first positioning portions 311 respectively disposed on two sides of the print head carrier 310 which are opposite to each other, for positioning the scanning assembly 30 relative to the imaging assembly 40. In this embodiment, the first positioning portion 311 is a protrusion.

The imaging assembly 40 is rotatable and detachably disposed in the accommodation space S1. In this embodiment, the imaging assembly 40 is located between the upper surface 130*s*, the lower surface 110*s* and the two side plate assemblies 120. Specifically, the imaging assembly 40 is located between the scanning assembly 30 and the lower surface 110*s*.

The imaging assembly 40 includes a toner cartridge 410 and a photosensitization unit 420. The photosensitization unit 420 is pivoted to the toner cartridge 410.

In detail, the toner cartridge 410 includes two pressing parts 411 and a toner container 413. The two pressing parts 411 are disposed on two sides of the toner container 413 which are opposite to each other, respectively. Each of the two pressing parts 411 has a first protrusion 4111 extending toward the side plate assembly 120. The two first protrusions 4111 are detachably disposed in the two first grooves 110*a*1, respectively. In addition, each of the two pressing parts 411 has a pressing surface 411*s*. The pressing surface 411*s* is a continuous surface corresponding to the pressed portion 230 of the rotatable member 20. Specifically, the pressing surface 411*s* faces the upper surface 130*s* and is inclined toward the lower surface 110*s*. In this embodiment, the toner container 413 contains toner powder (not shown).

The photosensitization unit 420 is disposed between the two pressing parts 411 and opposite to the toner container 413. In other words, the two pressing parts 411 are disposed on two ends of the photosensitization unit 420 which are opposite to each other, respectively. The toner container 413 and the photosensitization unit 420 are disposed on the same side of one of the pressing parts 411.

Specifically, as shown in FIG. 3, the photosensitization unit 420 includes a hollow frame 421 and a photoconductive drum 423. The hollow frame 421 has two second protrusions 4211 and two second positioning portions 4213. The two second protrusions 4211 are disposed on two ends of the hollow frame 421 which are opposite to each other, respectively. The two second protrusions 4211 penetrate through the two pressing parts 411, respectively. The two second protrusions 4211 are rotatable disposed in the two second grooves 110*a*2, respectively.

The two second positioning portions 4213 are disposed on two ends of the hollow frame 421 which are opposite to each other, respectively. The two second positioning portions 4213 match the two first positioning portions 311 on the print head carrier 310, respectively. As shown in FIG. 4, when the scanning assembly 30 is at the image capturing position, the first positioning portions 311 are disposed in the second positioning portions 4213. In this embodiment, the second positioning portion 4213 is a hole (blind hole) and the first positioning portion 311 is a protrusion, but the present disclosure is not limited thereto. In other embodiments, the first positioning portion 311 may be a hole, and the second positioning portion 4213 may be a protrusion.

The photoconductive drum 423 is pivoted to the hollow frame 421, and thus the photoconductive drum 423 is able to be rotated with respect to the hollow frame 421. In this embodiment, the photoconductive drum 423 is a cylindrical-shaped drum, and the hollow frame 421 is disposed on the photoconductive drum 423. In detail, the hollow frame 421 covers a part of the curved surface of the photoconductive drum 423 and two opposite ends of the photoconductive drum 423.

In addition, as shown in FIG. 3, the hollow frame 421 has a top surface 421*s* and a slot 421*a*. The top surface 421*s* faces the upper surface 130*s*. The slot 421*a* is formed on the top surface 421*s*. When the scanning assembly 30 is at the image capturing position, as shown in FIG. 4, the print head 320 of the scanning assembly 30 is moved into the hollow frame 421 through the slot 421*a* and being close to the photoconductive drum 423 for exposing the photoconductive drum 423. In this embodiment, when the scanning assembly 30 is at the image capturing position, the print head 320 and the photoconductive drum 423 are only spaced apart by a distance of about 0.5 mm to about 1 mm.

Figure 5A:
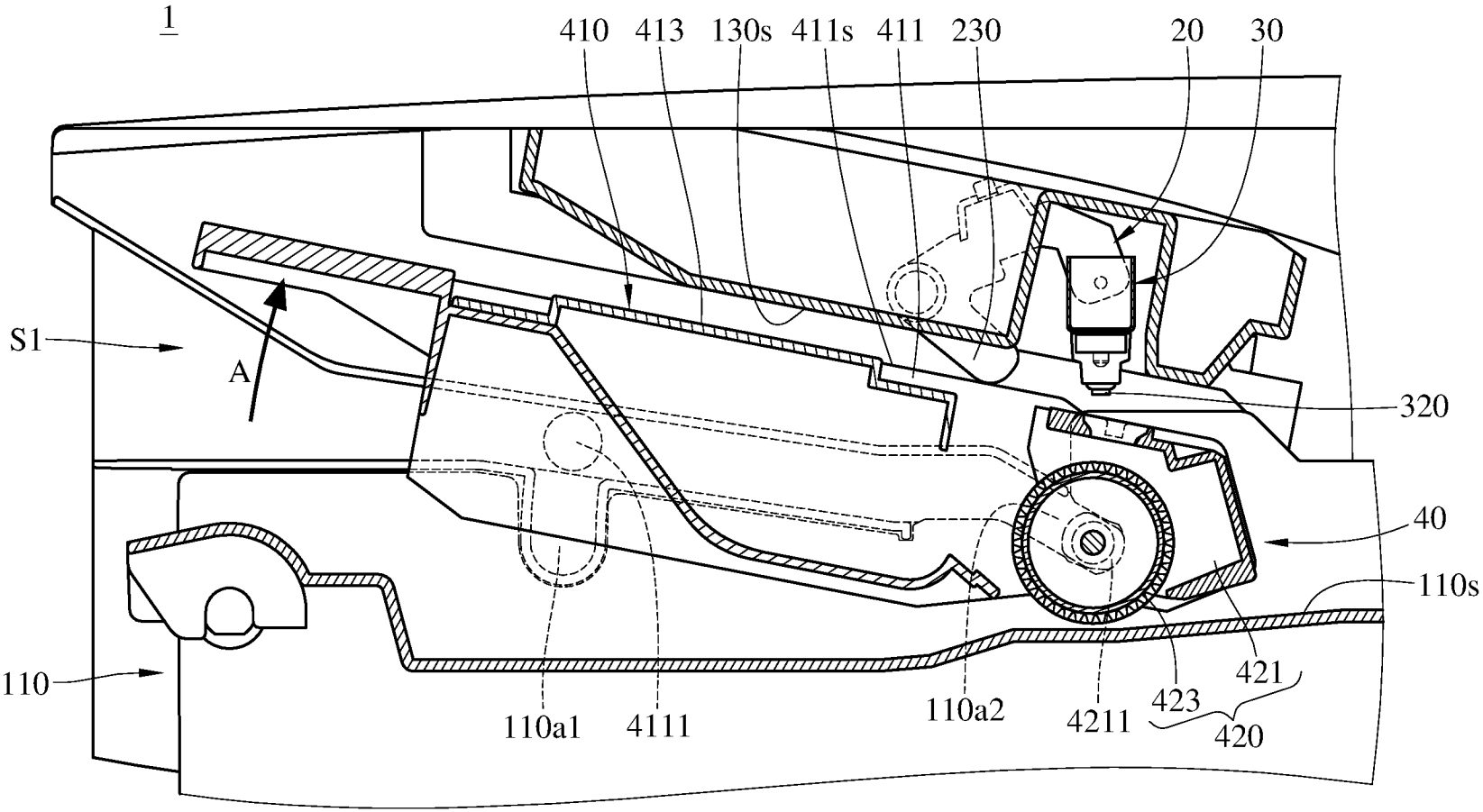
FIGS. 5A-5B are action views illustrating the imaging assembly according to the embodiment of the disclosure being removed from the accommodation space.
Figure 5B:
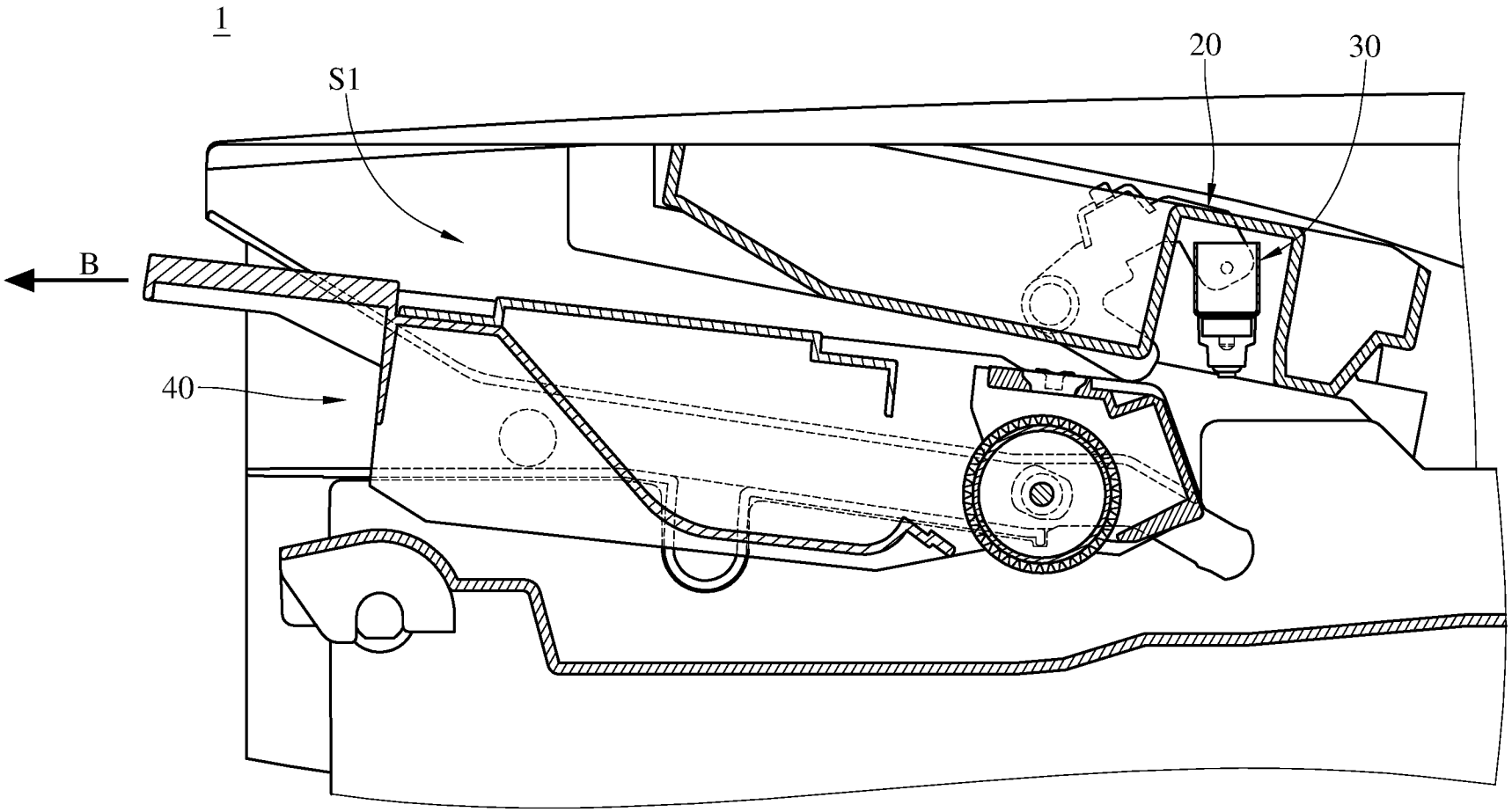

Then, please refer to FIG. 4 and FIGS. 5A-5B. FIGS. 5A-5B are action views illustrating the imaging assembly according to the embodiment of the disclosure being removed from the accommodation space.

Firstly, as shown in FIG. 5A, the toner container 413 is lifted up in the direction of an arrow A. Since the second protrusion 4211 of the imaging assembly 40 is pivoted to the second groove 110*a*2, the second protrusion 4211 is the rotating center of the imaging assembly 40. Thus when the toner container 413 is lifted up, the imaging assembly 40 is able to be rotated relative to the frame 10, but the photosensitization unit 420 is maintained to be close to the bearing plate 110. In such a case, the toner cartridge 410 is placed in a tilted manner and close to the upper surface 130*s*, and thus the pressing surfaces 411*s* of the pressing parts 411 of the toner cartridge 410 press the pressed portions 230 of the rotatable members 20 to rotate the rotatable members 20. Hence, the scanning assembly 30 is lifted from the image capturing position to the lifted position so that the scanning assembly 30 is away from the photosensitization unit 420 for preventing the collision between the scanning assembly 30 and the photoconductive drum 423. In details, when the scanning assembly 30 is lifted by the pressed portions 230 of the rotatable members 20, the print head 320 of the scanning assembly 30 is moved away from the photoconductive drum 423 and out of the photosensitization unit 420 through the slot 421*a* of the hollow frame 421.

Then, as shown in FIG. 5B, the imaging assembly 40 is detached or removed from the accommodation space S1 along the direction of an arrow B. Since the scanning assembly 30 is lifted up to the lifted position, the distance between the print head 320 of the scanning assembly 30 and the lower surface 110*s* is great enough for easily pulling the imaging assembly 40 out of the accommodation space S1 without damaging the print head 320.

Even though FIGS. 5A to 5B are actions of removing the imaging assembly 40 from the accommodation space S1, but it is noted that the scanning assembly 30 is able to be lifted to the lifted position for preventing the collision between the print head 320 and the photoconductive drum 423 of the photosensitization unit 420 during installing the imaging assembly 40 into the accommodation space S1.

In addition, since the pressing surface 411*s* is a continuous surface, the pressed portion 230 of the rotatable member 20 is in continuous contact with the pressing surface 411*s* during removing the imaging assembly 40 from the accommodation space S1 for preventing the imaging assembly 40 from returning back to the image capturing position, and therefore the collision between the imaging assembly 40 and the photosensitization unit 420 can be prevented.

In addition, the present disclosure is not limited to the length of the pressing surface 411*s*. In fact, any configuration of the pressing surface, which is able to be in continuous contact with the pressed portion 230 when the imaging assembly 40 is removed from and installed into the accommodation space S1, falls within the scope of the disclosure.

Moreover, the present disclosure is not limited to the quantity of the first positioning portions 311 on the print head carrier 310 and the quantity of the second positioning portions 4213 on the hollow frame 421. In other embodiments, the quantity of the first positioning portion 311 may be one, and the quantity of the second positioning portion 4213 may be one.

Furthermore, the present disclosure is not limited to the quantity of the rotatable member 20 and the quantity of the pressing part 411. In other embodiments, only one side of the imaging assembly 40 is equipped with one pressing part 411. In such a case, the quantity of the rotatable member 20 is one.

According to the imaging apparatus discussed above, when the imaging assembly is rotated relative to the frame, the pressed portion of the rotatable member is pressed by the pressing surface of the imaging assembly so that the scanning assembly pivoted to the rotatable member of the frame is able to be lifted up and away from the photosensitization unit of the imaging assembly. Hence, an accidental collision between the scanning assembly and the photosensitization unit is prevented during removing or installing the imaging assembly.

Compared to the traditional imaging apparatus with the scanning assembly being moved by the multi-bar linkage, the imaging apparatus provided in this disclosure is more simple in construction, thereby decreasing the cost and complexity of assembling the imaging assembly. In addition, compare to another traditional imaging apparatus with the scanning assembly being locked by the security lock mechanism, which takes two steps to install or remove the scanning assembly, the scanning assembly of the imaging apparatus provided in this disclosure is able to be installed or removed by only one step, which is more conveniently for user.

What is claimed is:

1. An imaging apparatus, comprising:

a frame comprising an accommodation space, a lower surface and a upper surface, and the lower surface and the upper surface respectively located on two sides of the accommodation space which are opposite to each other;

at least one rotatable member comprising a pressed portion, a pivoting portion and a arm, the pivoting portion pivoted to the frame and adjacent to the upper surface, and the pivoting portion located between and connected to the pressed portion and the arm;

a scanning assembly assembled to the arm and having an image capturing position and a lifted position relative to the upper surface, wherein the scanning assembly is movable between the image capturing position and the lifted position by the arm, the scanning assembly is away from the upper surface when the scanning assembly is at the image capturing position, and the scanning assembly is close to the upper surface when the scanning assembly is at the lifted position; and an imaging assembly rotatable and detachably disposed in the accommodation space, the imaging assembly located between the scanning assembly and the lower surface, the imaging assembly comprising a toner cartridge and a photosensitization unit which are connected to each other, the toner cartridge having at least one pressing surface, the at least one pressing surface facing the upper surface and corresponding to the pressed portion, and the imaging assembly being rotatable relative to the frame to move the toner cartridge to be alternatively close to or away from the upper surface, wherein when the toner cartridge is away from the upper surface, the scanning assembly is at the image capturing position and adjacent to the photosensitization unit, when the toner cartridge is close to the upper surface, the at least one pressing surface of the toner cartridge presses the pressed portion of the rotatable member, the scanning assembly is rotated to the lifted position by the at least one rotatable member, and the scanning assembly at the lifted position is away from the photosensitization unit.

2. The imaging apparatus according to claim 1, wherein when the scanning assembly is at the lifted position, the imaging assembly is rotatable relative to the frame so as to be removed from or put into the accommodation space, and the pressed portion of the at least one rotatable member is in continuous contact with the at least one pressing surface during the imaging assembly being removed from or put into the accommodation space.

3. The imaging apparatus according to claim 1, wherein the at least one pressing surface faces the upper surface and extends toward the lower surface.

4. The imaging apparatus according to claim 1, wherein the toner cartridge comprises at least one pressing part and a toner container, the toner container and the photosensitization unit are disposed on the same side of the at least one pressing part, and the at least one pressing surface is on the at least one pressing part.

5. The imaging apparatus according to claim 4, wherein the photosensitization unit comprises a hollow frame and a photoconductive drum, the hollow frame covers a part of the photoconductive drum, the hollow frame is pivoted to the at least one pressing part, and the photoconductive drum is pivoted to the at least one pressing part.

6. The imaging apparatus according to claim 5, wherein a top surface of the photosensitization unit is on the hollow frame, the hollow frame has a slot formed on the top surface, when the scanning assembly is at the image capturing position, and a part of the scanning assembly protrudes into the hollow frame through the slot.

7. The imaging apparatus according to claim 6, wherein the scanning assembly comprises a print head carrier and a print head, the print head is disposed on the print head carrier, the print head protrudes into the hollow frame through the slot when the scanning assembly is at the image capturing position.

8. The imaging apparatus according to claim 7, wherein the print head is a light emitting diode print head (LPH).

9. The imaging apparatus according to claim 7, wherein the print head carrier has at least one first positioning portion, the hollow frame has at least one second positioning portion, the at least one first positioning portion is disposed in the at least one second positioning portion when the scanning assembly is at the image capturing position.

10. The imaging apparatus according to claim 9, wherein the at least one first positioning portion is a protrusion, and the at least one second positioning portion is a hole which is matching the at least one first positioning portion.

11. The imaging apparatus according to claim 9, wherein the quantity of the at least one first positioning portion is two, the quantity of the at least one second positioning portion is two, the two first positioning portions are disposed on two ends of the print head carrier which are opposite to each other, respectively, and the two second positioning portion are disposed on two ends of the hollow frame which are opposite to each other, respectively.

12. The imaging apparatus according to claim 1, wherein the quantity of the at least one rotatable member is two, the arms of the two rotatable members are connected to two ends of the scanning assembly which are opposite to each other, respectively.

13. The imaging apparatus according to claim 11, wherein the quantity of the at least one pressing part is two, and the two pressing parts are disposed on two ends of the photosensitization unit which are opposite to each other, respectively.

* * * * *